US005269122A

United States Patent [19]

Reichental et al.

[11] Patent Number: 5,269,122

[45] Date of Patent: Dec. 14, 1993

[54] APPARATUS AND METHOD FOR FORMING PROTECTIVE PACKAGES

[75] Inventors: Abraham N. Reichental, Southbury; Alex Shafir, Watertown, both of Conn.

[73] Assignee: Sealed Air Corporation, Saddle Brook, N.J.

[21] Appl. No.: 814,110

[22] Filed: Dec. 26, 1991

[51] Int. Cl.[5] ..... B65B 9/02; B65B 51/16

[52] U.S. Cl. ..... 53/450; 53/553; 53/371.4; 53/374.4

[58] Field of Search ..... 53/228, 229, 550, 371.4, 53/374.4, 450, 466, 553

[56] References Cited

U.S. PATENT DOCUMENTS

| | | | |
|---|---|---|---|
| 3,338,023 | 8/1967 | Lazenby | 53/553 X |
| 3,357,151 | 12/1967 | Monaghan | 53/553 X |
| 3,411,263 | 11/1968 | Smolderen | 53/553 X |
| 3,503,175 | 3/1970 | Marasso et al. | 53/553 X |
| 3,552,088 | 1/1971 | Niwa | 53/374.4 X |
| 3,665,673 | 5/1972 | Billett et al. | 53/228 X |
| 3,677,861 | 7/1972 | Knauf | 53/371.4 X |
| 3,735,551 | 5/1973 | Pratt | 53/553 X |
| 3,792,561 | 2/1974 | Carnes | 53/228 X |
| 3,816,969 | 6/1974 | Zimmerman et al. . | |
| 3,824,908 | 7/1974 | Rowell | 53/553 X |
| 4,067,173 | 1/1978 | Borrello | 53/553 |
| 4,109,792 | 8/1978 | Greenawalt et al. | 53/374.4 X |
| 4,501,106 | 2/1985 | Treiber et al. . | |
| 4,514,965 | 5/1985 | Adachi et al. | 53/553 |
| 4,858,416 | 8/1989 | Monaghan | 53/553 X |
| 4,965,983 | 10/1990 | Muller et al. | 53/553 X |

*Primary Examiner*—Horace M. Culver

*Attorney, Agent, or Firm*—Bell, Seltzer, Park & Gibson

[57] ABSTRACT

An apparatus and method for producing protective packaging. The apparatus includes an article delivery means for delivering an article between a pair of continuous webs to a pouch forming section. A pouch forming section having guide means for forming a parallelogram shaped pouch around the article to be packaged and means to heat seal the lateral edges. The device further includes means to seal the ends of the pouch and separate the sealed packages.

10 Claims, 4 Drawing Sheets

APPARATUS AND METHOD FOR FORMING PROTECTIVE PACKAGES

FIELD OF THE INVENTION

The present invention relates to apparatus and method for wrapping and cushioning articles. More particularly, this invention relates to individually packaging articles from continuous rolls of heat sealable protective packaging material around a variety of different size and shape articles by forming a parallelogram-shape around each article and sealing the ends.

BACKGROUND OF THE INVENTION

Protective packaging for various articles of different sizes and shapes is commonly used to protect and cushion articles during mailing or shipping. One example of an apparatus for forming heat sealable packaging surrounding articles is described in U.S. Pat. No. 3,552,088 to Niwa. In such apparatus articles are successively placed at spaces between a pair of heat sealable webs which are being longitudinally fed through a sealer. The sheets are first heat sealed at each end of the article and subsequently sealed on each side. The wrapped articles are separated one from the other to provide a series of separate packages with the package being sealed on all four sides. The object of this apparatus is to provide wrinkle free packaging by forming side seals on each package, the transverse sealing of which has been finished while at the same time pulling the opposite lateral sides of the sheets outward aslant with respect to the direction in which the package is being conveyed.

Another article packaging system is disclosed in U.S. Pat. No. 3,357,151 to Monoghan which describes a sleeve-wrap machine which purports to provide a means for weakening the webs in the cross-web direction. Articles are continuously advanced between two continuous webs of thermoplastic shrink wrap material. Prior to entering the package forming operation each web is weakened at the joint between each successive package using a roll containing needle-like teeth. The lateral edges are sealed by radiant heat to form a tube which is transported to a heat shrinking tunnel to shrink the webs about the article. When the article leaves the tunnel the webs rupture at the weakened point under the tensile stress to separate the preceding wrapped article from the succeeding article.

One difficulty with presently available machines is the ability to package articles of different sizes and shapes without changing the parameters of the machine. Thus, the need remains for providing an improved packaging system which will produce protective packaging around a variety of articles using a varied selection of available wrap materials that can be chosen for each user's needs.

SUMMARY OF THE INVENTION

Therefore, it is an object of the present invention to provide a method and apparatus for producing protective packaging around a wide range of size and shape articles in which the packaged article is suitable for shipping or mailing.

Another object of this invention is to provide an apparatus for forming protective packaging from web material from a roll in discrete segments of a desired length.

A further object of this invention is to provide a compact package forming apparatus which may be conveniently used at a packaging site.

Yet another object of this invention is to provide a method for producing a parallelogram shaped pouch from two continuous webs of packaging material around an article to be packaged, sealing the edges of the pouch to form a packaged article and separating the packages from each other.

These and other objects, features and advantages of the present invention are achieved in the embodiments illustrates herein, by the provision of an apparatus and method for forming a parallelogram shaped pouch of heat sealable joined web packaging material around the article to be packaged. The apparatus includes means for supplying continuous webs of heat-sealable packaging material to a pouch forming station. The articles to be packaged, which may vary in size and shape, are successively passed to the pouch forming station at a predetermined spacing between the continuous webs. As the article is passed through the pouch forming section the webs pass around pouch forming guides as the side edges of the continuous webs are held together between pairs of side rolls to form a tube-like parallelogram shape around the article. Each side of the webs forming the parallelogram where the web edges meet are heat-sealed forming a pouch around the article. The pouch is then passed to an end seal and cut mechanism to seal the rear end of a preceding wrapped article and simultaneously seal the forward end of the succeeding pouch while separating the completely seal package from the partially sealed pouch.

BRIEF DESCRIPTION OF THE DRAWINGS

Other objects, features and advantages of the invention will be apparent from the detailed description of the invention when taken in conjunction with the accompanying drawings, in which.

DESCRIPTION OF THE PREFERRED EMBODIMENTS

Figure 1:
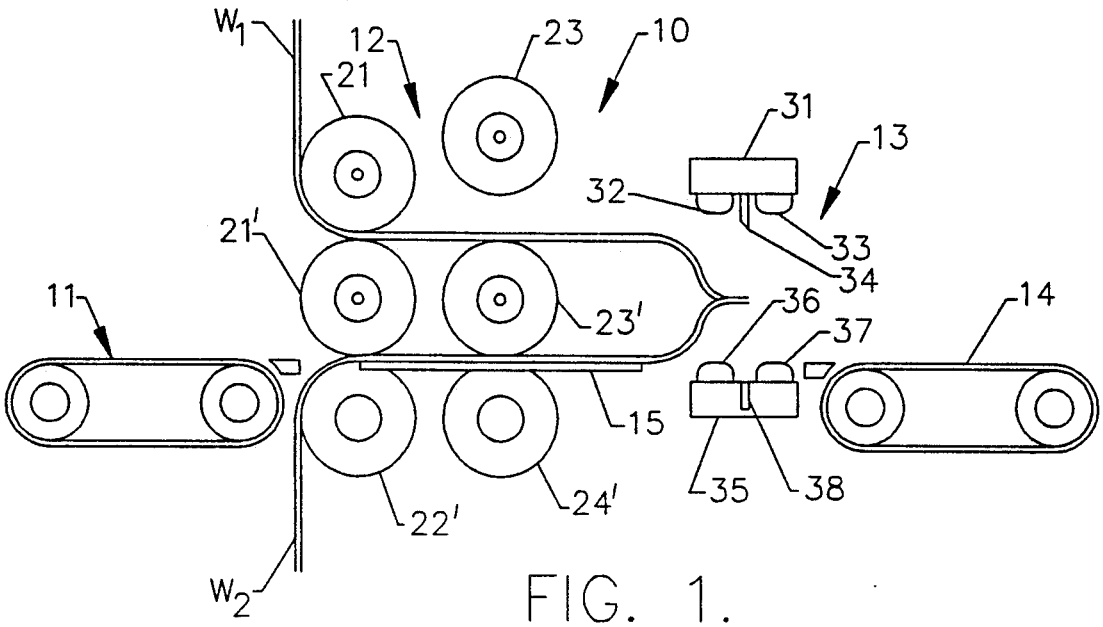
FIG. 1 is a schematic side view of the package forming device which embodies the features of the present invention.

Referring more specifically to the drawings, there is shown an embodiment of an apparatus for forming a package from two continuous webs in accordance with the present invention. In the illustrated embodiment shown in FIG. 1, the packaging apparatus is generally indicated at 10. The apparatus 10 comprises an article delivery means 11, a pouch forming section 12, an end sealing and cutting assembly 13 and an exit delivery means 14. FIGS. 1-5 illustrate the succeeding steps in forming a package using the apparatus of this invention. The package P is formed from continuous webs of heat sealable packaging materials $W_1$ and $W_2$. The apparatus is shown in FIG. 1 without the presence of an article to be packaged. The continuous webs are supplied to the pouch forming section 12, normally from bulk supply rolls supported on free rolling armatures. While the packaging materials contemplated for use in the package forming apparatus of this invention are especially suited for mailing wrapped articles, it should be understood that the package forming materials for use in this invention are only limited by the fact that the edges of the webs must be heat sealed. An example of a suitable packaging material is a small bubble wrap laminated to kraft paper, such as Jiffy Lite® sold by Sealed Air Corporation.

The article A to be packaged is supplied to pouch forming section 12 by delivery means 11. It should be understood that, if desired, the articles may be hand fed to the pouch forming section, however, a preferred means of delivery is by a feed conveyor belt which brings the article to be packaged between the continuous webs. The pouch forming section may be operated continuously or intermittently. In either mode of operation delivery means 11, or other appropriate means of supplying article A, the article to be packaged is fed to the pouch forming section 12 so that the articles are positioned at a predetermined spacing between continuous webs $W_1$ and $W_2$. The size of the articles that can be packaged is constrained only by the width of the machine, the height of the formed pouch and the selected length. The length of the packaging material forming the pouch is preferably set by an electronics control module (not shown) but may be set manually. Each article may vary in size and shape.

Figure 2:
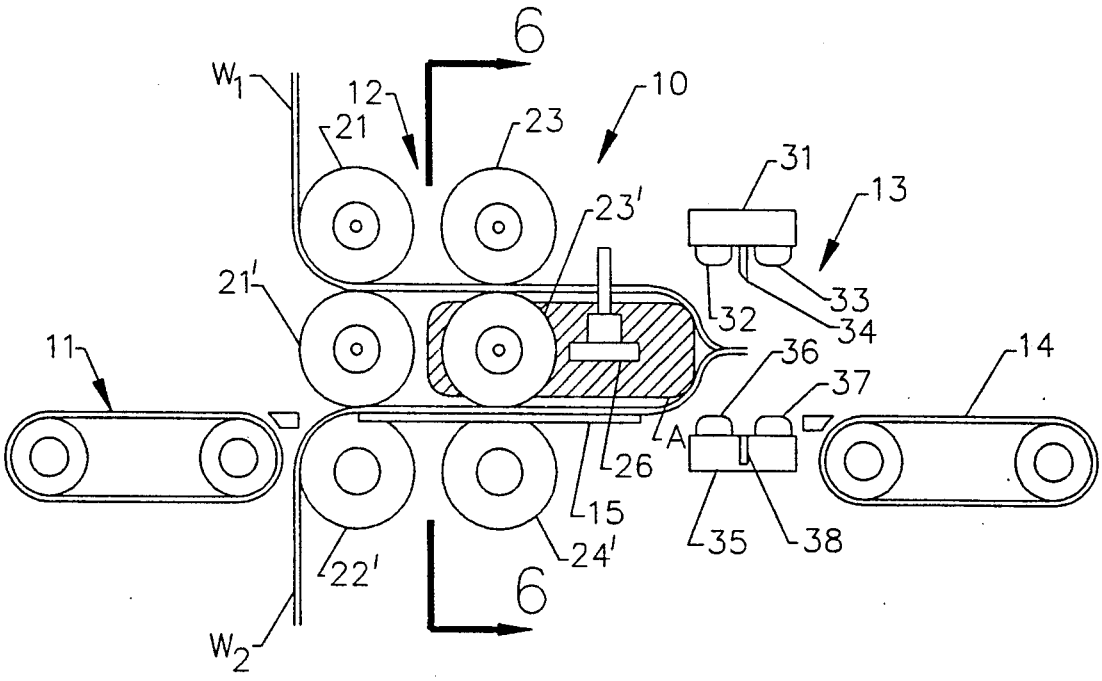
FIG. 2 is a schematic side view of the package forming device of the present invention showing an article in the pouch forming area and illustrating the web materials passing along the path of travel through the pouch forming section.
Figure 6:
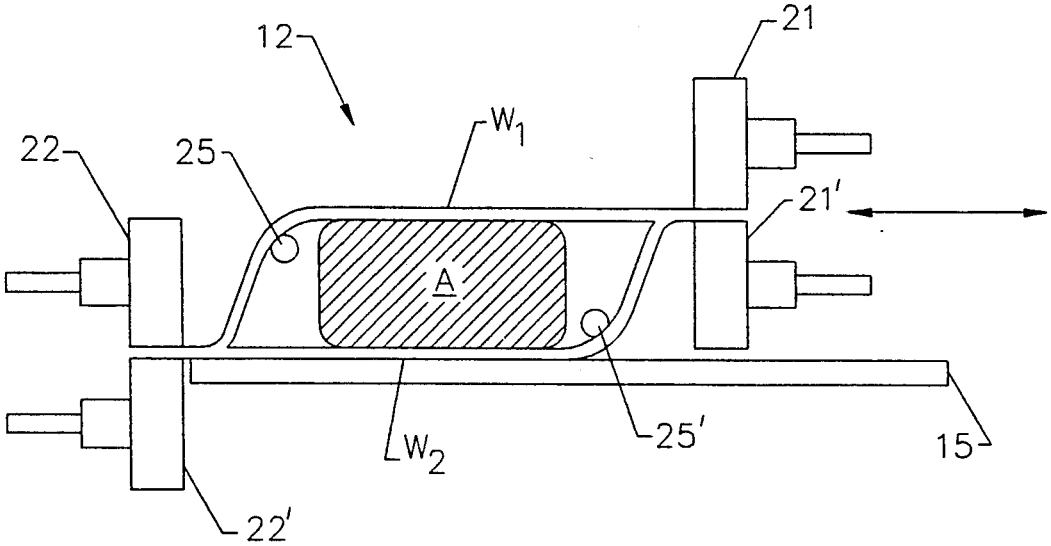
FIG. 6 is a schematic end view of the package forming device taken along line 6—6 of FIG. 2 illustrating the pouch forming guides.

As shown in FIG. 2, article A to be packaged passes into the pouch forming section 12 between continuous webs $W_1$ and $W_2$. In the embodiment shown article A sits on web $W_2$ and is carried through the apparatus while setting thereon. Lower web $W_2$, while in the pouch forming section rests on support platform 15. As shown in FIG. 6, pouch forming section 12 comprises pouch forming guides 25, 25' which are positioned to form, when used with the drive rolls as hereinafter described, a tube-like parallelogram shaped pouch around article A. Continuous webs $W_1$ and $W_2$ are driven through pouch section 12 by a pair of right side drive rolls 21 and 21' and a pair of left side drive rolls 22 and 22' each pair being in nip forming relationship, and means for driving said rolls (not shown) to advance the web through pouch forming section 12 a distance appropriate for the article to be enclosed. The pairs of drive rolls serve to hold the lateral edges of continuous webs $W_1$ and $W_2$ together until the lateral edges are sealed. As shown in FIG. 6 the webs are so positioned that when used with the pouch forming guides 25, 25' a parallelogram is formed. It should be understood that means for driving the webs through the pouch forming section may be used.

Following each pair of drive rolls is a pair of side heat seal rolls 23, 23' and 24, 24'. As shown in FIG. 1, the heat seal rolls are disengaged when the apparatus is at rest. As shown in FIG. 2, each pair of sealing rollers is moved into heat sealing relationship to seal each lateral edge of the package. A motor, not shown, drives the pairs of drive rolls and the pairs of heated rolls. A suitable gear arrangement is also provided to engage and drive the pairs of rolls. The distance between the opposed lateral seals may be varied according to the size of the article to be packaged.

In one embodiment of this invention the package formed from the pouch may contain gussets on each side. The gussets may be formed by edge gusset rolls disposed on each side of the pouch forming section following the heat sealing rolls. As shown in FIG. 2 one such embodiment includes edge gusset roll 26. It is understood that the opposite side of said pouch will have a similar edge gusset roll. The edge gusset rolls are selectively moveable to engage the pouch when gussets are desired.

Figure 3:
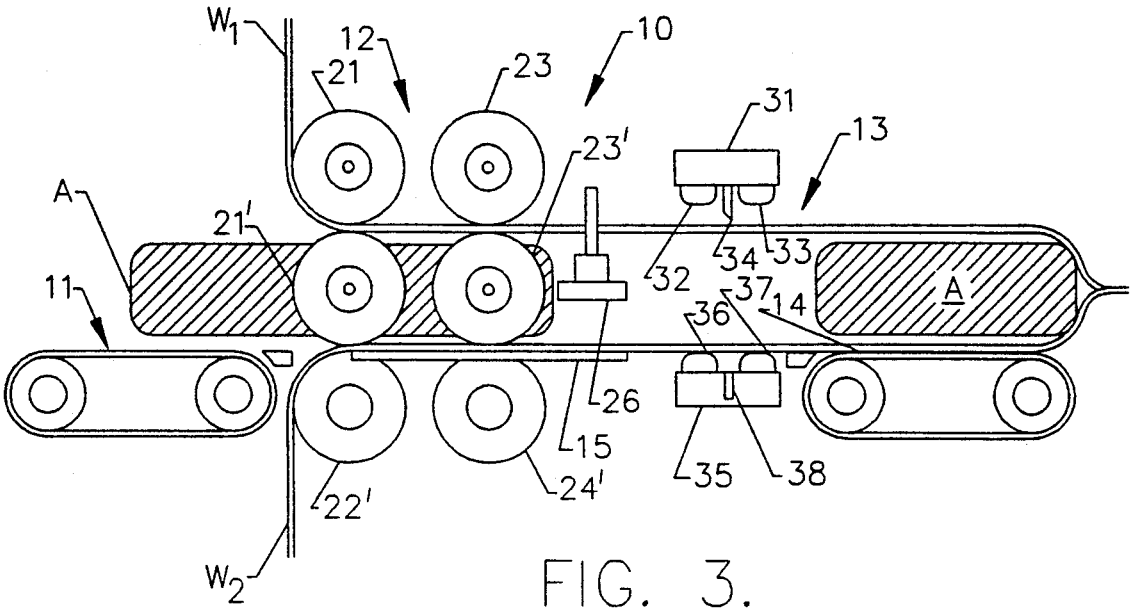
FIG. 3 is a schematic side view of the package forming device of the present invention showing the article to be packaged in a partially formed package and a succeeding article entering the pouch forming section.
Figure 4:
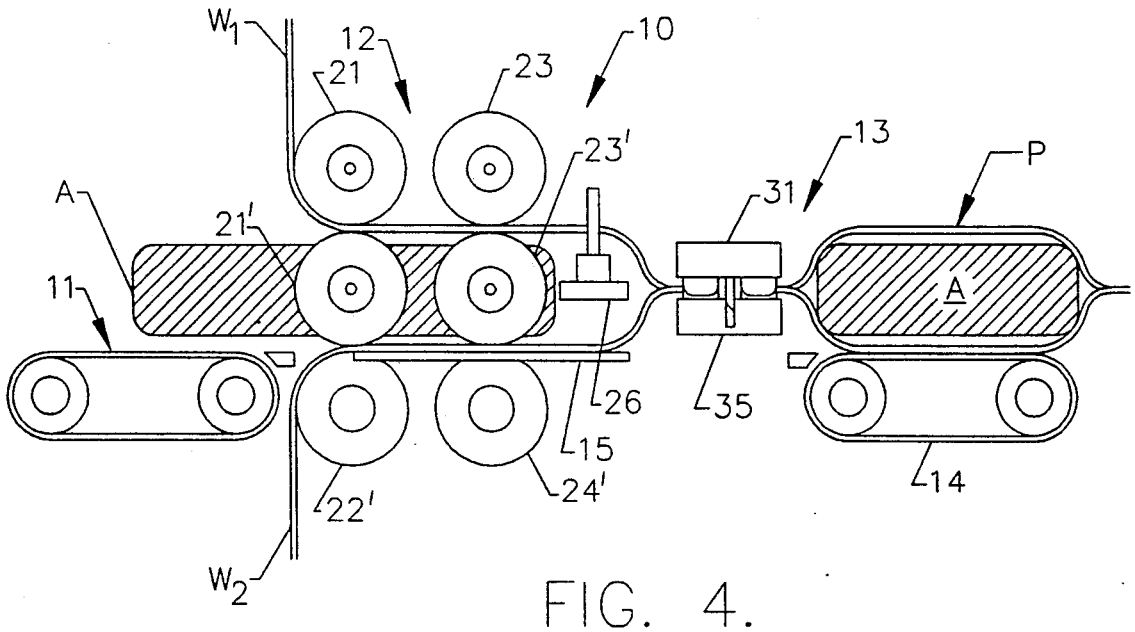
FIG. 4 is a schematic side view of the package forming device of the present invention illustrating the completion (sealing of the second end of the package) of a first package and the sealing of a first end of a second package.

Referring again to the FIG. 1 there is shown a conventional, end sealing and cutting assembly 13 in its raised or at rest position. Assembly 13 comprises an upper end cut and seal bar assembly, generally designated 31, having a pair of horizontally spaced apart, front and rear heat sealing bars generally designated 32, 33. Disposed between the heat sealing bars is knife 34 which separates a completely sealed package from the succeeding partially sealed package. The upper end cut and seal bar assembly 31 is positioned in reciprocally engaging relationship with lower cut and seal bar assembly 35. Lower cut and seal bar assembly 35 comprises lower front and rear heat sealing bars 36 37 and a slot 38 for engaging knife 34 to make a smooth cut. As shown in FIGS. 3 and 4, as a partially sealed (sealed on three sides) pouch is moved through exit delivery means 14, such as the conveyor belt shown, the succeeding partially formed package (sealed on the lateral edges) is in pouch forming section 12. The advance of the apparatus stops and end sealing and cutting assembly 13 is activated. A heat seal controller (not shown) includes controls of a conventional kind and is adapted to send pneumatic power to reciprocate the upper end cut and seal bar. In an alternate form, the upper bar may be actuated electrically, as by solenoids or hydraulically, if desired. FIG. 4 shows assembly 13 at the end of the cutting cycle. The rear end of the forward package is sealed between upper heating bar 33 and lower heating bar 37. At the same time the forward end of the succeeding package is sealed between the upper heating bar 32 and lower heating bar 36. The knife 34 simultaneously cuts the forward package from the later package. The end sealing and cutting assembly is generally of conventional construction.

Figure 5:
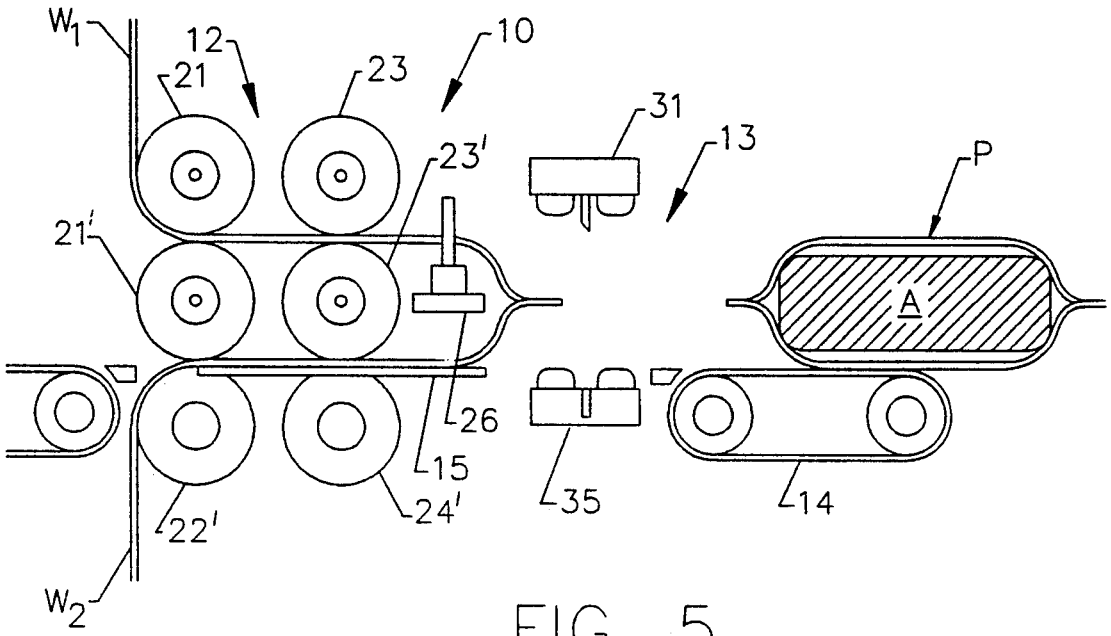
FIG. 5 is a schematic side view of the package forming device of the present invention illustrating a completed package.
Figure 7:
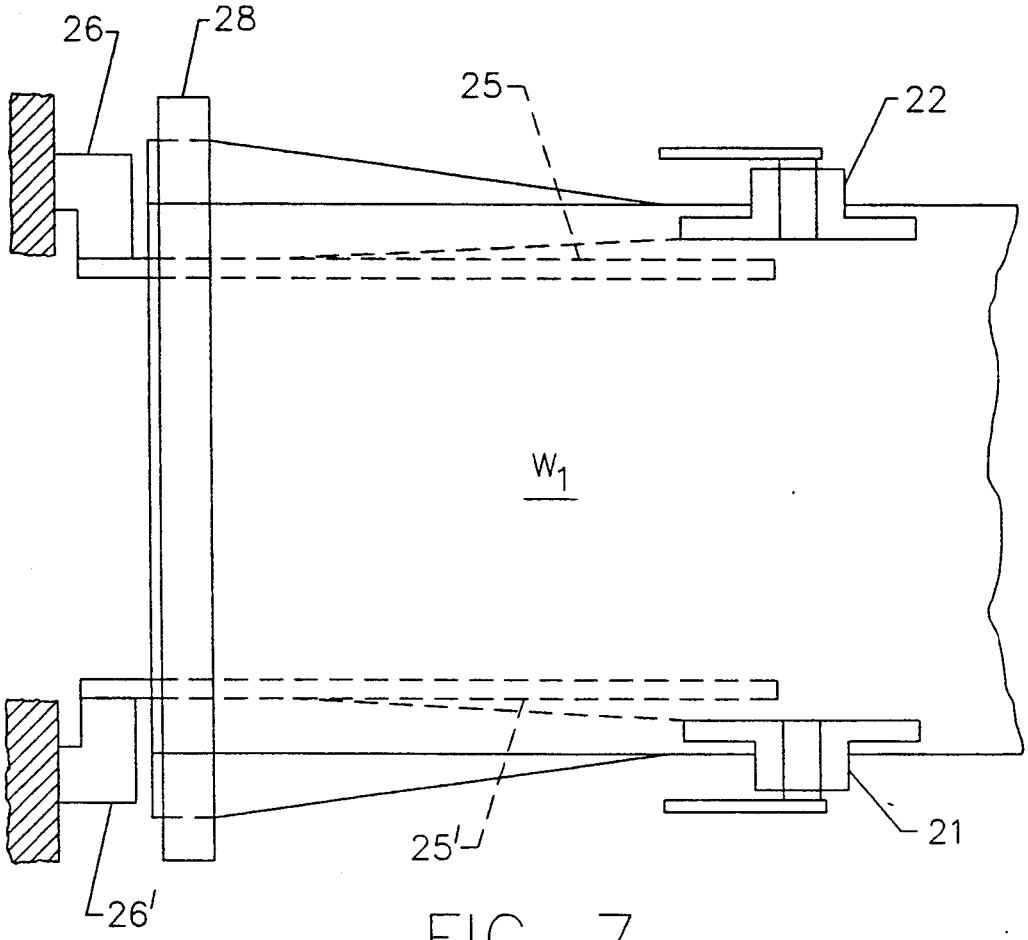
FIG. 7 is a partial top view of the package forming device showing the pouch forming guides.

FIG. 5 illustrates the completed packaging cycle and shows the completely sealed package exiting from the apparatus. The package formed using the apparatus of the invention is conveniently formed for different sized articles by forming the parallelogram pouch as shown in FIG. 6. The parallelogram forming guides 25, 25' are positioned between continuous webs $W_1$ and $W_2$ by supports 26 and 26' attached to the frame as shown most clearly in FIG. 7. Continuous web $W_1$ enters the pouch forming section by passing around guide bar 28.

The operation of the pouch forming device is as follows: The operator places the article a maximum of six inches into the opening of the machine where the two webs of flexible wrap come together to form the beginning of a sealed pouch. After activation by either a keypad or foot pedal, the article and the wrap material simultaneously feed through the device a specified length past the end cut and seal assembly 13. The feed and guide mechanisms will form and heat seal the two webs of packaging material into a parallelogram shaped pouch extending above and below the product. The height of the pouch will be preset and the width determined by the wrap material supply. The selection by the operator on the control keypad will instruct the device to feed and cut the pouch off at the desired length. The pouch will be heat sealed and cut from the wrap material supply by a device that simultaneously forms the leading edge of the next incoming pouch. An exit roller will convey the wrapped product out of the device completely sealed and ready for shipping or mailing.

The invention has been described in detail with particular reference to a preferred embodiment and the operation thereof, but it is understood that variations, modifications, and the substitution of equivalent means can be effected within the spirit and scope of this invention.

What is claimed is:

1. An apparatus for forming packages from continuous webs comprising:

means for directing a pair of continuous webs of heat-sealable packaging material in a predetermined path of travel;

means for positioning articles to be packaged at a predetermined spacing between the pair of continuous webs of heat-sealable packaging material;

a pouch forming section positioned along said predetermined path of travel and comprising means for moving the article and the continuous webs in a predetermined direction through said pouch forming section, and means for forming a parallelogram shaped pouch from the continuous webs said means for forming a parallelogram shaped pouch positioned to form the parallelogram shape surrounding the article in the traverse direction of the predetermined path of travel;

sealing means for heat sealing the side edges of the continuous webs which surround the article;

means for heat sealing the front end of the parallelogram shaped pouch and sealing the rear end of a preceding pouch to provide a completely sealed package; and means for separating the rear end of the sealed package from the front end of the succeeding pouch.

2. The apparatus defined in claim 1 further comprising means for exiting the sealed package from said end sealing means.

3. The apparatus defined in claim 1 wherein said means for selectively feeding articles to be packaged is a conveyer belt.

4. The apparatus defined in claim 1 wherein said means for moving the article and the continuous webs comprises a pair of left side drive rollers and a pair of right side drive rollers, each pair of rollers forming a nip and means for rotating said drive rollers to advance webs through said pouch forming section whereby the nip of one pair of said drive rollers is located above the nip of the other pair of drive rollers.

5. The apparatus defined in claim 1 wherein said means for forming said parallelogram shaped pouch are guide means.

6. The apparatus defined in claim 1 wherein said first sealing means comprises pairs of rolls.

7. The apparatus defined in claim 1 wherein said second sealing means comprises upper and lower end cut and seal bars assemblies.

8. The apparatus defined in claim 1 further comprising gusset form rolls for forming gussets in the lateral sides of the formed pouch.

9. A method for successively forming continuous webs into package comprising:

advancing upper and lower continuous webs while forming a parallelogram shaped pouch said parallelogram shaped pouch being formed in the traverse direction of the advancing webs and past pairs of nip forming drive rolls to maintain the edges of said webs together;

feeding an article to be packaged between said continuous webs;

heat sealing the lateral edges of said upper and lower webs;

heat sealing the formed ends of said webs to each other while effecting separation of the webs from a preceding package; and removing the thus packaged product from the package forming section.

10. A method for successively forming upper and lower continuous webs into packages comprising:

heat sealing the forward ends of the webs to each other, while effecting separation of the webs from a preceding package and while heat sealing the rear ends of the preceding package during separation therefrom;

advancing the upper and lower continuous webs through a predetermined path of travel while forming the webs into a parallelogram shaped pouch said parallelogram shaped pouch being formed in the TRAVERSE direction of the advancing webs with the side edges of the webs maintained in contact with each other;

while feeding an article to be packaged into the parallelogram shaped pouch; and heat sealing the side edges of the webs to each other.

* * * * *